United States Patent [19]

Van Klompenburg

[11] Patent Number: 4,702,297

[45] Date of Patent: Oct. 27, 1987

[54] FIELD INSTALLABLE ROLLING SCREEN ASSEMBLY

[75] Inventor: Marlo Van Klompenburg, Pella, Iowa

[73] Assignee: Rolscreen Company, Pella, Iowa

[21] Appl. No.: 896,813

[22] Filed: Oct. 6, 1986

Related U.S. Application Data

[62] Division of Ser. No. 646,647, Aug. 31, 1984, Pat. No. 4,658,879.

[51] Int. Cl.[4] ..... E06B 9/17

[52] U.S. Cl. ..... 160/271; 160/278; 160/290 R; 160/23 R

[58] Field of Search ..... 160/23 R, 267, 268, 160/270, 271, 278, 280, 281, 31, 290 R

[56] References Cited

U.S. PATENT DOCUMENTS

| | | | |
|---|---|---|---|
| 510,336 | 12/1893 | Felthousen | 160/271 |
| 716,208 | 12/1902 | Duchemin | 160/271 X |
| 808,400 | 12/1905 | Parsons | 160/267 |
| 998,006 | 7/1911 | Hutchison | 160/271 |
| 1,370,500 | 3/1921 | Jones | 160/23 R |
| 2,131,521 | 9/1938 | Nye | 160/278 |
| 4,168,734 | 9/1979 | Holmqvist et al. | 160/23 R |
| 4,398,585 | 8/1983 | Marlow | 160/23 R |
| 4,399,855 | 8/1983 | Volfson | 160/23 R |

*Primary Examiner*—Ramon S. Britts
*Assistant Examiner*—David M. Purol
*Attorney, Agent, or Firm*—Zarley, McKee, Thomte, Voorhees & Sease

[57] ABSTRACT

A rolling window screen assembly is provided for a window frame having a sill, a head and opposite side jambs. The screen assembly comprises a screen mounted at the head of the window frame and being unrollable along the jambs thereof. A pair of guide members are mounted on and extend along each side jamb for guiding the opposite edges of the screen as the screen is unrolled along the jambs. Control levers adjacent each side edge of the screen frictionally engage the guide members so as to control the position of the screen along the guide members. The guide members are mounted to the window frame jambs by a plurality of L-shaped clips which extend through a corresponding slot in the respective guide members. A spring is positioned in each guide member for centering the unrolled screen between the pair of guide members.

12 Claims, 21 Drawing Figures

FIELD INSTALLABLE ROLLING SCREEN ASSEMBLY

This is a division of application Ser. No. 646,647, filed Aug. 31, 1984, now U.S. Pat. No. 4,658,879.

BACKGROUND OF THE INVENTION

This invention relates to window screen construction, and more particularly to rolling window screens.

Window screens are often constructed to be of wire or plastic mesh stretched flat across a rigid, rectangular frame. While such screens are popular, a disadvantage is that the screens obscure clear vision through windows, and are subject to wear and damage even while not in use.

An alternative to flat screens was introduced about fifty years ago, and was a basis for the founding of the Rolscreen Company of Pella, Iowa. This alternative was the rolling screen which, like a window blind, was pulled downward from a roll atop an open window and released to be returned upward by spring action to the roll.

The rolling screen was improved over the years and had many advantages, but it did retain some disadvantages and limitations. A major limitation was that the construction of the rolling screen required that it be factory produced as a component of a special casement window. The rolling screen was not adaptable to standard casement windows, and could not be installed by distributors or owners to such windows. As a result, the screen required special ordering of the special casement windows, with the predictable increased costs of limited, special order production; increased inventory; and the like.

A disadvantage of the rolling screen was that the screen was only positionable either fully retracted or fully extended. The screen did not allow for convenient operation of casement window accessories. The screen rose rapidly to a retracted position, sometimes at a surprising speed.

SUMMARY OF THE INVENTION

An object accomplished by the present invention is the provision of a rolling screen assembly which can be applied to standard casement windows.

Another object of the invention is a rolling screen assembly which can be readily installed by a variety of persons using standard household tools.

A further object of the invention is a rolling screen assembly which is lockable at a variety of partially raised and lowered positions, to accommodate window accessories such as modern venetian blinds.

These and other objects are accomplished by the invention.

In a principal aspect, then, the invention is a rolling window screen assembly adapted to be installed to a casement window frame. The window comprises a sill, a head and two jambs. The rolling screen assembly comprises first, a screen box mounting means for being field-installed to the frame and for supporting a hereinafter-described screen box means at the top of the frame. Second, a screen box means is provided for being field-installed on and supported by the screen box mounting brackets, and for providing a contained a rolling screen mounted on a roll. A control bar is attached to the rolling screen. A screen guide mounting means is field-installed to the jambs, for supporting hereinafter described screen guide means. The screen guide means is field-installed on and supported by the screen guide mounting clips to the jambs, for guiding the screen while unrolled along the jambs. Finally, a control means on the control bar and screen guides controlls the position of the control bar and thereby the screen along the screen guides.

These and other objects, aspects and advantages of the invention are more fully set forth in the detailed description of the preferred embodiment, which follows a brief description of the accompanying drawing.

BRIEF DESCRIPTION OF THE DRAWING

The accompanying drawing includes twenty-one FIGS. or FIGS. as follows.

DETAILED DESCRIPTION OF THE PREFERRED EMBODIMENT

Figure 1:
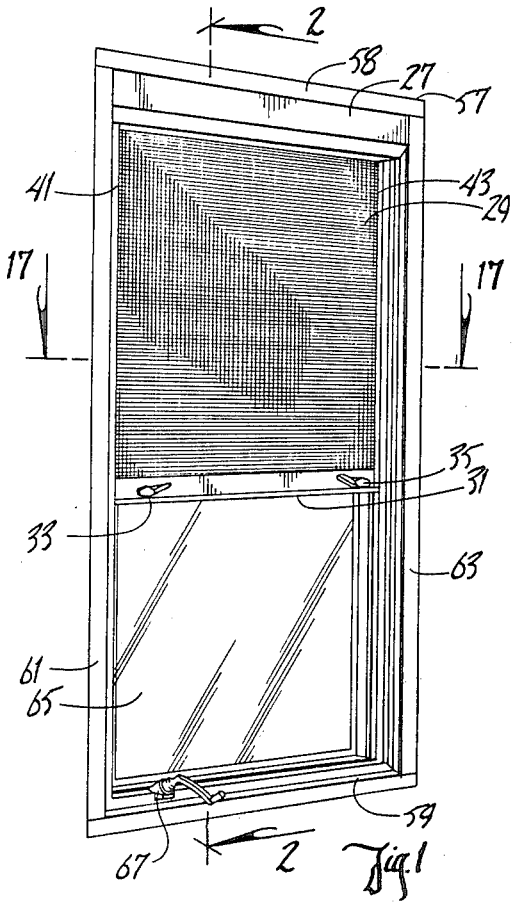
FIG. 1 is an interior perspective view of a casement window including the rolling screen assembly which is the preferred embodiment of the invention.
Figure 2:
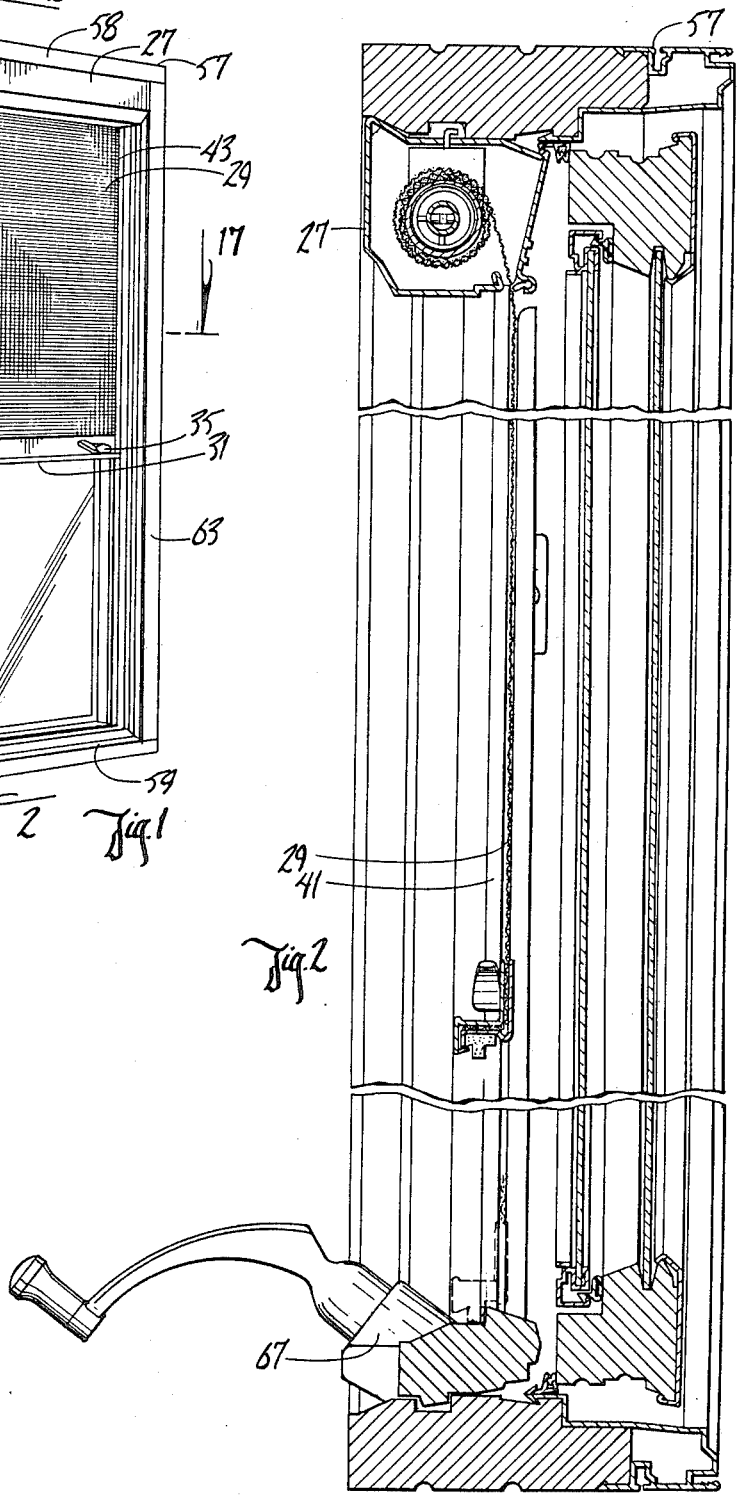
FIG. 2 is a shortened, vertical cross-section view of the window and rolling screen assembly of FIG. 1.

Referring to FIGS. 1 and 2, the preferred embodiment of the invention is a field-installable rolling window screen assembly generally designated 25. The assembly 25 is field-installable in that it may be installed on window structures after their complete manufacture. The assembly may be installed by trained personnel of window structure distributors, or homeowners with an ordinary assortment of tools. The basic components of the assembly are a screen box 27, a screen 29, a screen control bar 31, control bar locking mechanisms 33, 35, screen box mounting brackets such as 37 (FIGS. 4–8), screen guides 41, 43, and a plurality of screen guide mounting clips 45, 47, 49, 51, 53, 55 (FIGS. 9–12). All the foregoing components are field-installable.

The assembly 25 is installable in a casement window 57. As conventional, the window 57 includes a horizontally extending head 58 and sill 59, two vertically extending jambs 61, 63, a sash 65 and a sash opening mechanism 67. The sash 65 is mounted to the window 57 for manual pivoting in an arc substantially about a vertical axis along a jamb. Further details of the window 57, not a part of this invention, are provided in the remaining figures.

Figure 3:
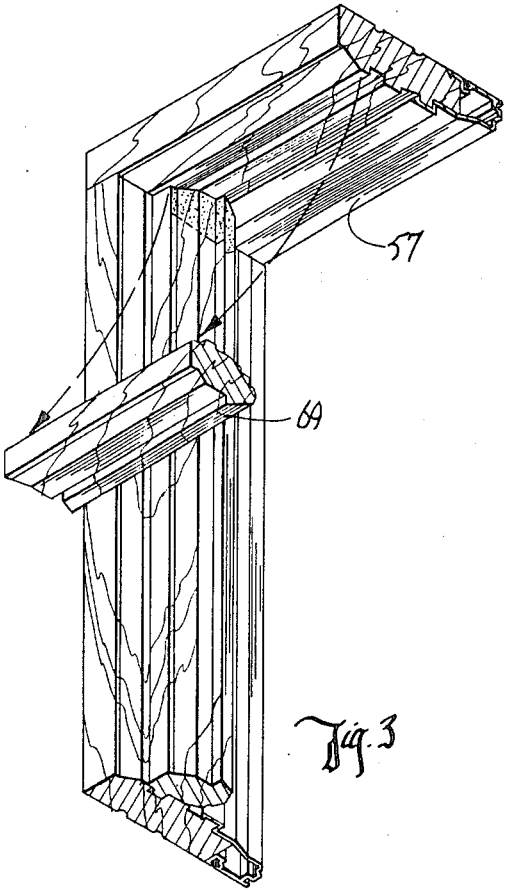
FIG. 3 is a perspective view of a portion of the frame of the window of FIGS. 1 and 2, during preparation of the frame for installation of the preferred rolling screen assembly.

Referring to FIG. 3, installation of the assembly 25 begins with removal of a jamb stop 69 from the window 57. The stop 69 is pried from the window frame. Any remaining, protruding nails are clipped with wire cutters.

Figure 4:
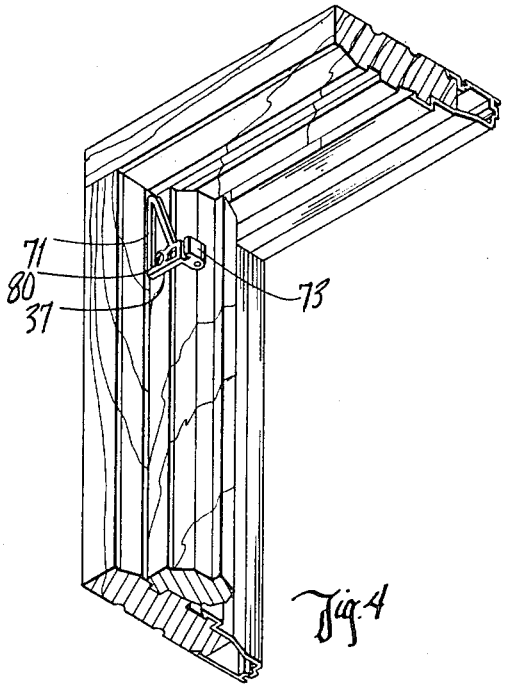
FIG. 4 is a perspective view of a portion of the window frame of FIGS. 1–3, during a first step of installation of the screen box mounting brackets of the preferred rolling screen assembly.
Figure 5:
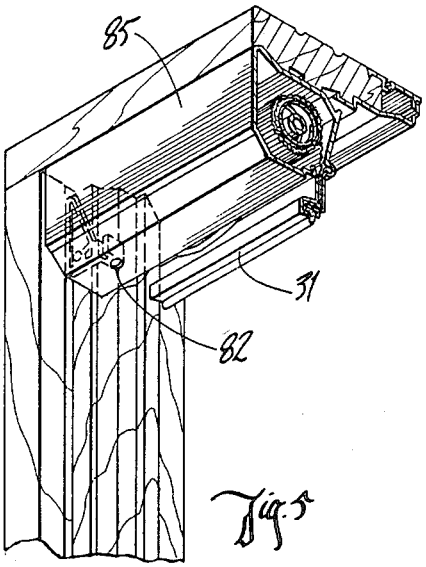
FIG. 5 is a perspective view of a portion of the window frame of FIGS. 1–4, with the screen box of the preferred rolling screen assembly installed on the mounting brackets of FIG. 4.
Figure 6:
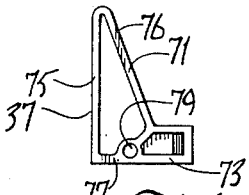
FIG. 6 is a front elevation view of the screen box mounting brackets of FIG. 4.
Figure 7:
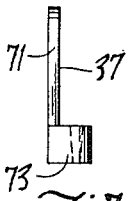
FIG. 7 is a side elevation view of the screen box mounting brackets of FIGS. 4 and 6.
Figure 8:
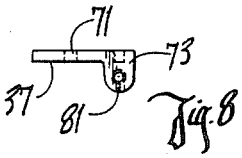
FIG. 8 is a top view of the screen box mounting brackets of FIGS. 4, 6 and 7.

The screen box mounting brackets are then installed as in FIG. 4, to support the screen box as in FIG. 5. The brackets are formed of a strong, rigid material, such as metal or certain plastics. Referring to FIGS. 6–8, each mounting bracket such as bracket 37, includes a jamb abutting portion 71 and a projecting portion 73. The portion 71 comprises three triangle-forming members 75, 76 77 and a first fastener receiver 79. The members 75–77 provide a jamb abutting surface and a head abutting point for accurate placement of the bracket in relation to the jamb and window head. The first fastener receiver 79 is positioned relative to the members 75–77 for guiding a fastener such as a wood screw 80 into the jamb.

The bracket projecting portion 73 projects from the portion 71 and includes a second fastener receiver 81. The receiver 81 is turned at a right angle from the receiver 79. As shown in FIG. 5, a fastener such as a screw 82 is received and guided in the receiver 81, after being passed through an appropriately placed fastener opening in the screen box housing 85. The screw is driven vertically upward into the receiver 81, for ease of installation and removal, if necessary.

Figure 9:
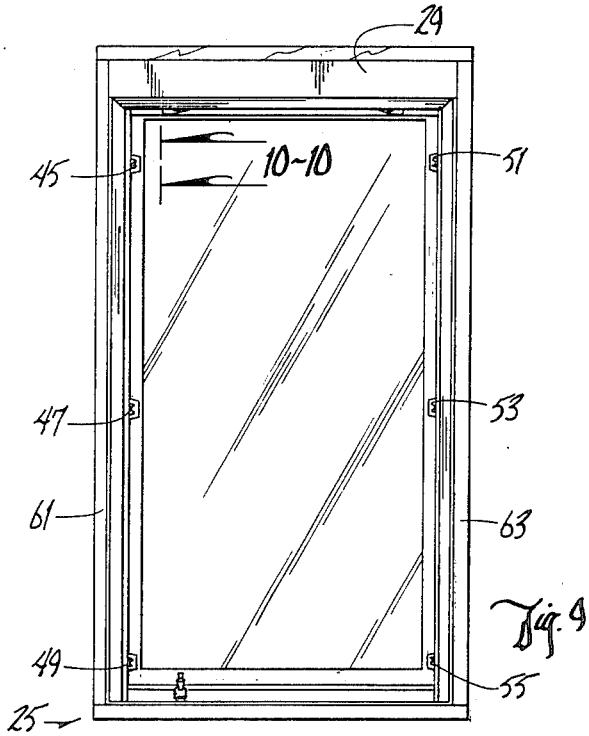
FIG. 9 is an interior elevation view of the casement window of FIGS. 1–5, during a step of installation of screen guide mounting clips of the preferred rolling screen assembly.
Figure 10:
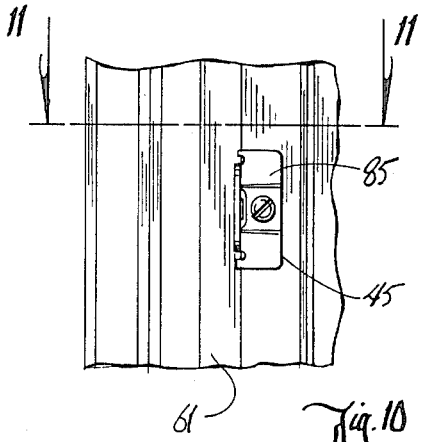
FIG. 10 is an elevation view, taken along line 10—10 in FIG. 9, of a screen guide mounting clip and a portion of the window frame of the preferred rolling screen assembly.
Figure 11:
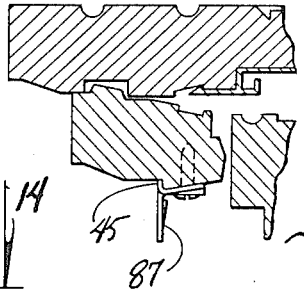
FIG. 11 is a cross-section view of the window frame portion of FIG. 10, taken along line 11—11 in FIG. 10.
Figure 15:
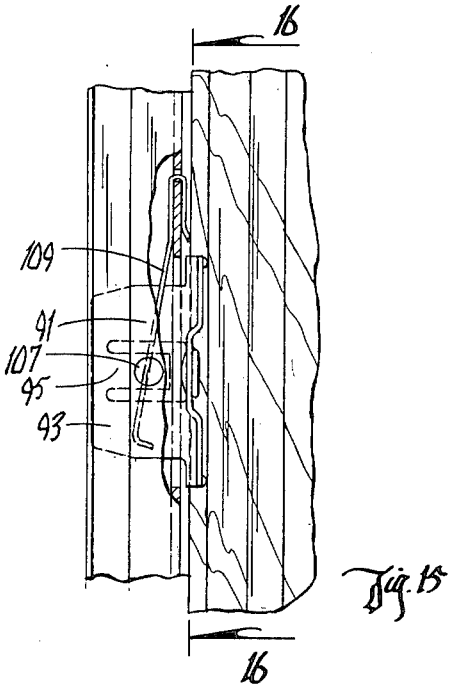
FIG. 15 is a partially broken away, exterior elevation view of the window frame and installed screen guide of FIGS. 13 and 14, viewed from along line 15–15 of FIG. 14.
Figure 16:
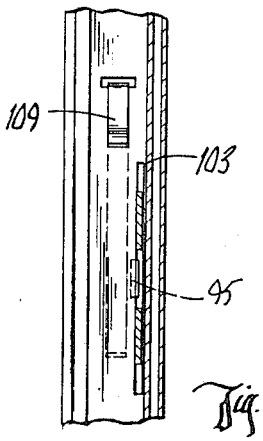
FIG. 16 is a cross-section view of the screen guide of FIGS. 12–15, taken along line 16—16 of FIG. 15.

After the brackets and screen box 27 are filed-installed, the clips 45, 47, 49, 51, 53, 55 are installed. As shown in FIG. 9, the clips are arranged three to a jamb in spaced relation to one other. Each clip, such as clip 45 in FIGS. 10 and 11, is of strong, rigid material, and includes a jamb attachment portion 85 and a substantially right angled projection 87. The attachment portion 85 is screw fastened through an opening to the jamb. Two sides 91, 93 (FIG. 15) of the projection 87 extends from the attachment portion 85 to the outer end of the projection 87, where they are joined. A locking tab 95 extends back toward the attachment portion 85 from the projection outer end, and from between the two sides 91, 93. The tab is a spring member, resiliently movable into and out of the plane of the sides 91, 93. When not deflected under a force, the tab is angled from the plane of the sides, as best shown in FIG. 11.

Figure 12:
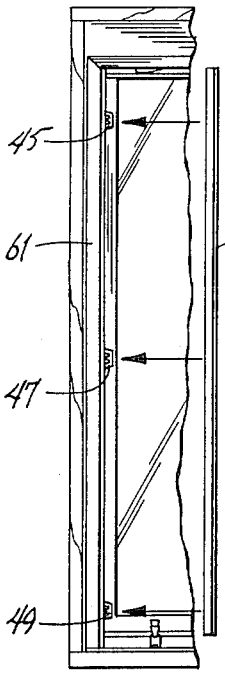
FIG. 12 is an interior elevation view of a portion of the window of FIGS. 1–5 and 9–11, during installation of a screen guide of the preferred rolling screen assembly on the clips of FIGS. 10 and 11.
Figure 13:
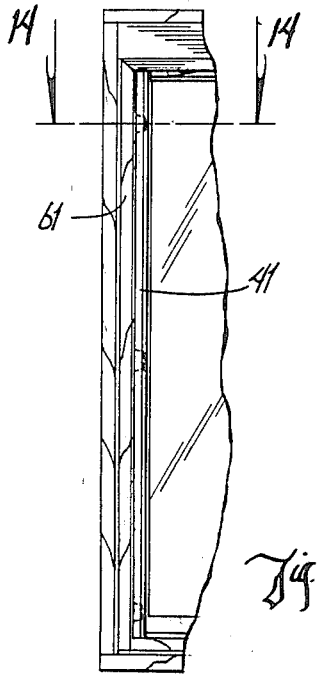
FIG. 13 is an interior elevation view, similar to FIG. 12, of a window portion with a screen guide installed.

The screen guides 41, 43 are mounted on the clips 45, 47, 49, 51, 53, 55. As shown in FIGS. 12 and 13, each guide, such as guide 41, is pressed into place on its corresponding clips. The guide is captured by the clips and held against the adjacent jamb.

Figure 14:
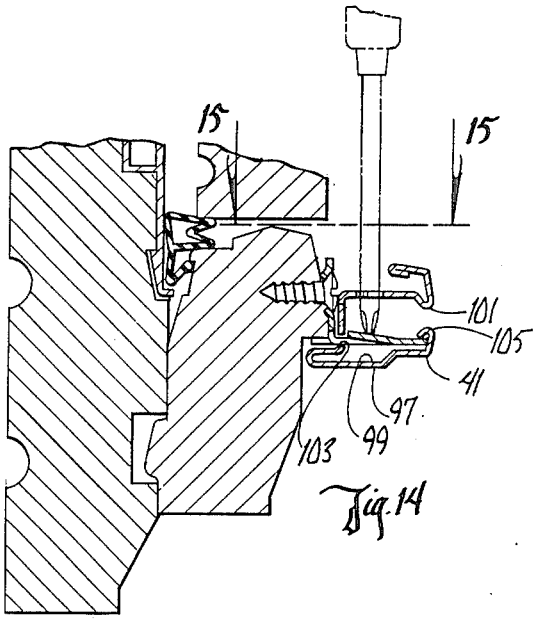
FIG. 14 is a cross-section view of the window frame and installed screen guide of FIG. 13 taken along line 14–14 of FIG. 13.

Referring to FIG. 14, each elongated screen guide such as 41 is metal and has a shaped guide wall 97 forming a screen and clip channel 99. The channel extends the full length of the guide, and is open through an elongated mouth 101 to receive an edge of the screen 29. A plurality of abbreviated clip slots 103 equal to the number of clips are defined in the guide wall 97 opposite the mouth 101. A clip edge hook 105 is formed adjacent the mouth.

During installation of the screen guides 41, 43, as in FIGS. 12 and 13, each clip projection 87 is pressed through a clip slot 103. The slot width is limited to less than the width of the clip at the undeflected locking tab 95. Thus, as the clip projection is pressed in the slot, the locking tab is deflected. As the projection outer edge enters the clip edge hook 105, the tab 95 becomes free of the slot, returns to its unflexed position, and thereafter locks the screen guide to the jamb.

Removal of the guide is caused by flexure of the tab 95, as by a screwdriver, shown in phantom in FIG. 14, placed through an opening 107, followed by separation of the clips and guides. To provide a bug-proof seal at the ends of the control bar 31, a screen diverter 109 aligns the control bar 31 in a substantially "centered" position with respect to the jambs when the control bar is in the lowest position.

Figure 18:
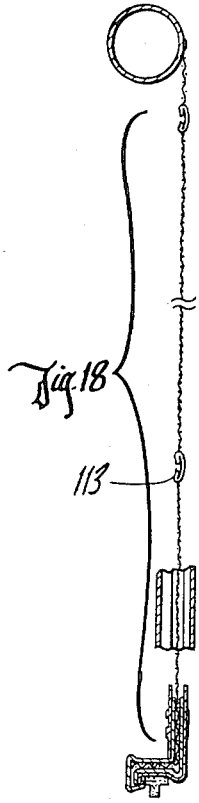
FIG. 18 is a shortened, vertical cross-section view of the preferred rolling screen assembly.

With the screen guides 41, 43 in place, the control bar 31 is pulled from the screen box and fitted to the guides. Referring to FIG. 18, the screen 29 is attached to the control bar 31 and to a spring-biased roll 111 in the screen box 27. As in FIG. 5, the control bar is recessable into the screen box, for minimum interference with sight through the window. When the control bar is pulled, the screen follows, and unrolls from the roll 111. (If the control bar is moved toward the screen box, the screen returns to the roll.)

Lugs such as lug 113 are fastened along the screen edges. The lugs have a curvature substantially equal to the curvature of the roll 111.

Figure 17:
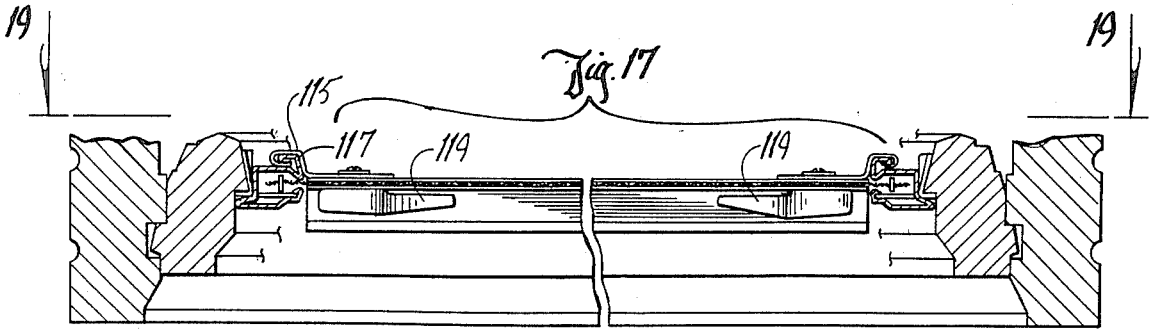
FIG. 17 is a shortened, cross-section view of the window and rolling screen assembly taken along line 17—17 of FIG. 1.
Figure 19:
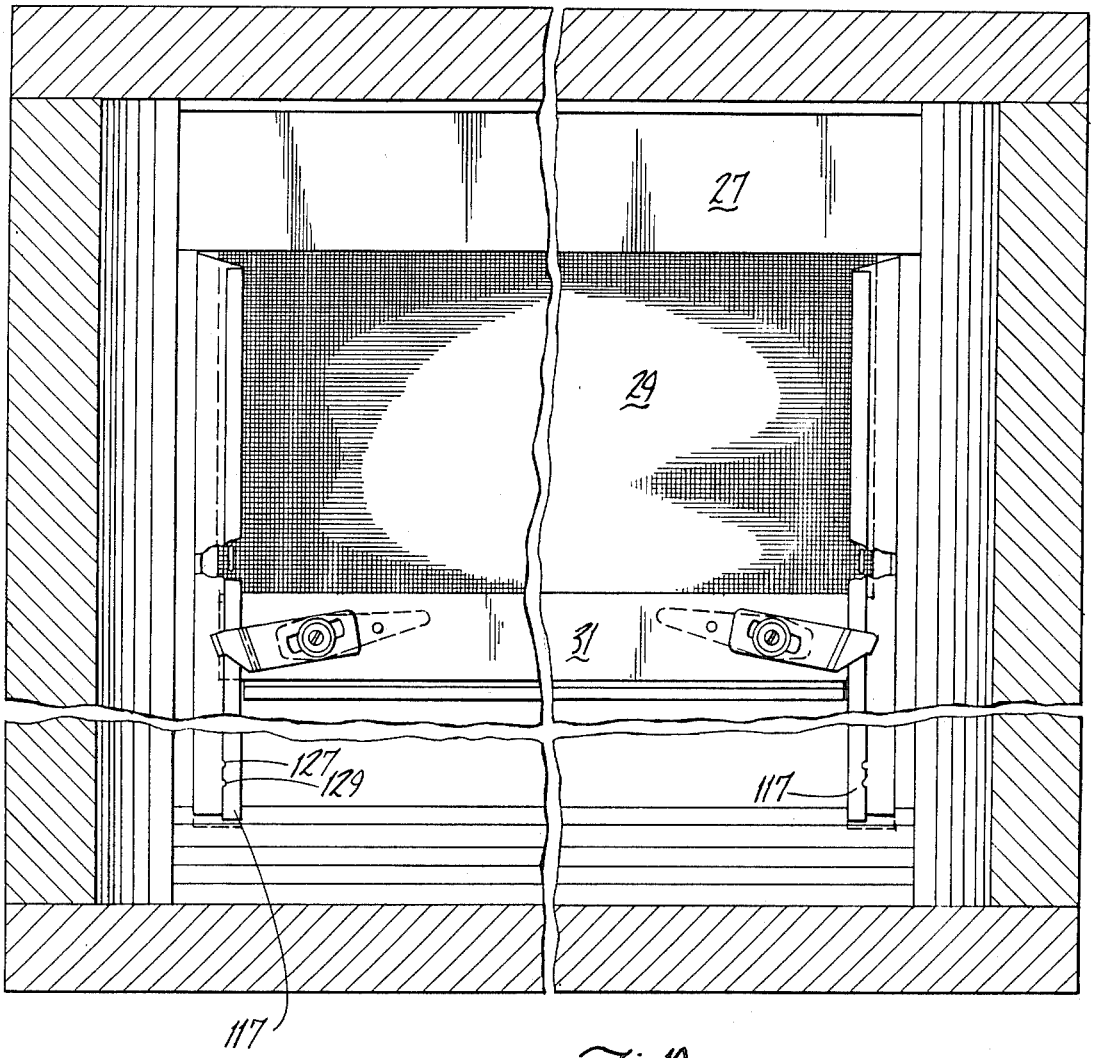
FIG. 19 is a shortened, interior elevation view of the window and preferred rolling screen assembly.
Figure 20:
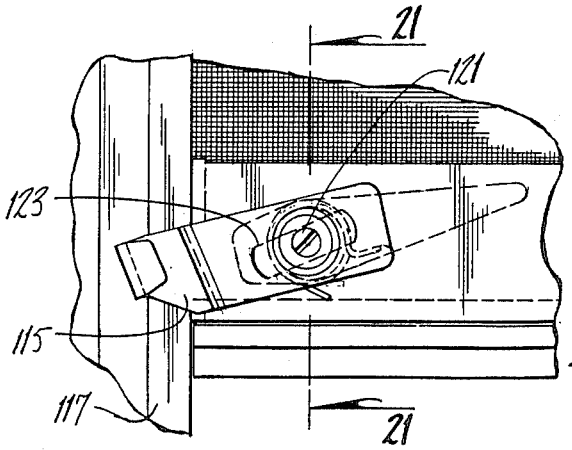
FIG. 20 is a detail view of a control bar lock of the preferred rolling screen assembly.
Figure 21:
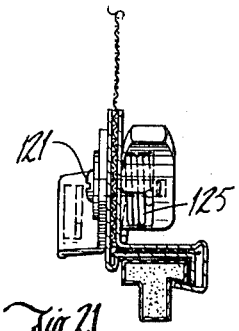
FIG. 21 is a cross-section view of a control bar lock of the preferred rolling screen assembly, taken along line 21—21 in FIG. 20.

Two locking mechanisms lock the control bar 31 in any position of the control bar relative to the screens. As shown in FIG. 17, each locking mechanism includes a manually operable lock actuator 119. Referring to FIGS. 19–21, each lock actuator 119 is rotatably mounted on the control bar, as by a screw 121. On the opposite side of the control bar from the actuator, a lock member 115 is also rotatably mounted by the screw 121. The lock member 115 has a portion hooked about a locking flange 117 of the screen guide. This is slidable along the flange, and capable of "seating against" the flange to retain the control bar relative to the screen guides by friction.

A second portion of the lock member includes a slot 123 through which the lock member is mounted to the lock actuator. The slot provides for lateral movement of the lock member relative to the lock actuator to prevent binding against the locking flange due to window width variations.

A spring 125 biases the lock actuator to a lock actuating position, and thereby the locking member to a locking position, as in FIGS. 19–21. The lock actuator is rotatable to a non-actuating position, and the locking member to a lock releasing position.

For most positive locking of the control bar against the sill 59, each screen guide includes two lock dimples 127, 129 along the locking flange 117. For positive locking in other positions, the screen guides are finished with paint along one side only, away from the locking flanges, the locking flanges are bare metal.

The preferred embodiment of the invention is now described. This preferred embodiment constitutes the best mode contemplated by the inventor of carrying out the invention. The invention, and the manner and process of making and using it, have been described in full, clear, concise and exact terms to enable any person skilled in the art to make and use the same. Because the invention may be copied without the copying of the precise details of the preferred embodiment, the following claims particularly point out and distinctly claim the subject matter which the inventor regards as his invention and wishes to protect.

I regard as invention and claim:

1. A rolling window screen assembly installed in a window frame, said frame including a sill, a head, and side jambs, said assembly comprising:

a screen mounted on said window frame adjacent said head thereof and being unrollable along said jambs of said window frame, said screen having opposite side edges, an upper edge, a lower edge, and opposite interior and exterior surfaces;

a pair of elongated guide means mounted on and extending along each of said side jambs for guiding said opposite edges of said screen while said screen is unrolled along said jambs;

a pair of control means adjacent each side edge of said screen for frictionally engaging said guide means to control the position of said screen along said guide means;

each of said guide means including a base extending along said jamb, spaced apart front and back legs depending from said base and extending away from said jamb so as to define a screen channel therebetween, and a flange extending from said back leg;

each of said control means including a pivot pin extending through said screen adjacent said lower edge thereof, a lock member pivotally mounted on said pivot pin adjacent said exterior surface of said screen and extending around said flange on said back leg of said guide means, spring means for normally biasing said lock member into frictional engagement with said flange such that said screen is maintained in position anywhere along the length of said guide means, and a lock actuator adjacent said interior surface of said screen operatively connected to said lock member and adapted to be manually actuated to overcome the bias of said spring means such that said lock member is slidable along said flange, said spring means including a spring having first and second end portions, said first end portion engaging said screen and said second end portion engaging said lock actuator in biased opposition to said first end portion, such that said spring means automatically rotationally urges said lock member into frictional engagement with said flange at all times after said manual actuation of said lock actuator is terminated.

2. The assembly of claim 1 wherein each of said lock members includes a slot therein through which said pivot pin extends such that said lock member is slidable with respect to said pivot pin thereby allowing said lock members to slide along said flanges of said guide means without binding thereagainst when the distance between said pair of guide means varies along the length thereof.

3. The assembly of claim 1 wherein said flange on said guide means includes a first portion connected to said back leg and extending away from said front leg and a second portion connected to said first portion and extending towards said jamb of said window frame.

4. The assembly of claim 3 wherein said lock member includes a channel-shaped end portion nested around said second portion of said flange of said guide means.

5. The structure of claim 1 wherein said spring is further defined as being a torsion spring.

6. The structure of claim 1 wherein said first end portion of said spring is further defined as engaging the lower edge of said screen.

7. A rolling window screen assembly adapted to be installed in a window frame, said frame including a sill, a head, and side jambs, said assembly comprising:

a screen mounted on said window frame adjacent said head thereof and being rollable along said jambs of said window frame between an upper retracted position and a lower unrolled position, said screen having opposite side edges, an upper edge, a lower edge, and being normally biased to roll upwardly to said retracted position;

a pair of elongated guide means mounted on and extending a long each of said side jambs for guiding said opposite edges of said screen while said screen is rolled along said jambs;

a pair of control means adjacent each side edge and said lower edge of said screen for frictionally engaging said guide means to control the position of said screen along said guide means;

each of said control means including a lock member pivotally mounted on said screen for frictionally engaging said guide means, spring means for normally rotationally biasing said lock member into frictional engagement with said guide means such that said screen is locked in position anywhere along the length of said guide means in opposition to the upward bias of said screen, and a lock actuator connected to said lock member and adapted to be manually actuated to overcome the bias of said spring means such that said lock member is released from frictional engagement with said guide means such that said screen is movable to said retracted rolled up position, said spring means including a spring having first and second end portions, said first end portion engaging said screen and said second end portion engaging said lock actuator in biased opposition to said first end portion, such that said spring means automatically rotationally urges said lock member into frictional engagement with said guide means at all times after manual actuation of said lock actuator is terminated.

8. The assembly of claim 7 wherein lock actuators must be simultaneously actuated to overcome the bias of the spring means such that said screen can be moved to said retracted rolled up position.

9. The assembly of claim 7 wherein said lock members are positioned relative to said guide means such that the friction between said lock members and said guide means increases with an increase in the upward bias of said screen to move upwardly to said retracted positions.

10. The assembly claim 7 wherein said guide means includes a jaw edge and said guide means includes a flange edge, said jaw edge frictionally engaging said flange edge to lock said screen in position when manual actuation of said lock actuator is terminated.

11. The structure of claim 7 wherein said spring is further defined as being a torsion spring.

12. The structure of claim 7 wherein said first end portion of said spring is further defined as engaging the lower edge of said screen.

* * * * *